United States Patent [19]

Darken

[11] Patent Number: 4,617,205

[45] Date of Patent: Oct. 14, 1986

[54] FORMALDEHYDE-FREE AUTOCATALYTIC ELECTROLESS COPPER PLATING

[75] Inventor: Jeffrey Darken, Woking, England

[73] Assignee: OMI International Corporation, Warren, Mich.

[21] Appl. No.: 809,979

[22] Filed: Dec. 17, 1985

[30] Foreign Application Priority Data

Dec. 21, 1984 [GB] United Kingdom ..... 8432395
Dec. 21, 1984 [GB] United Kingdom ..... 8432400

[51] Int. Cl.[4] ..... C23C 3/02

[52] U.S. Cl. ..... 427/305; 106/1.23; 106/1.26; 427/437; 427/443.1; 428/936

[58] Field of Search ..... 106/1.23, 1.26; 427/305, 437, 443.1; 428/936

[56] References Cited

U.S. PATENT DOCUMENTS 4,209,331 6/1980 Kukanskis et al. ..... 106/1.23

*Primary Examiner*—Lorenzo B. Hayes
*Attorney, Agent, or Firm*—Richard P. Mueller

[57] ABSTRACT

Copper may be deposited non-electrolytically from a composition comprising copper ions, a complexor to keep the copper ions in solution, and glyoxylate ions as a reducing agent. The use of formaldehyde is therefore avoided.

20 Claims, No Drawings

FORMALDEHYDE-FREE AUTOCATALYTIC ELECTROLESS COPPER PLATING

This invention relates to the electroless plating of copper from baths which do not use formaldehyde as the primary reducing agent and may therefore be free of formaldehyde.

Formaldehyde and its polymers have long been used as reducing agents in the electroless deposition of copper onto non-conductive surfaces such as printed circuit boards (PCBs) and plastics. But concern has recently risen about the use of formaldehyde: it is toxic, volatile and suspected of being a carcinogen. Its use is strictly regulated in technologically advanced countries and there has been speculation that the regulations could be tightened still further.

Formaldehyde is believed to act by reacting with a hydroxyl ion to form a hydride ion (P. Vaillagou and J. Pelissier, *Traitements de Surface,* 148, September 1976, pp 41–45) which is generally adsorbed into an activated surface to render it catalytic. In the absence of a reducible species such as a copper (II) ion, the hydride ion reduces a different molecule of formaldehyde to methanol. This self-oxidation/reduction of formaldehyde is known as the Cannizzaro reaction. But when an appropriate reducible species is present, then it is duly reduced. In this way copper ions are reduced to copper metal. It is because of the generation of the hydride ion that the electroless deposition of copper using formaldehyde as a reducing agent is said to be 'autocatalytic'; this means that when copper is to be plated onto a surface which has been previously activated to render it catalytic it is possible to achieve a deposit which is thicker than a mere flash. The reason for this is that when the catalytic sites of the surface are obscured by the plated layer, the continuation of the reduction reaction in this case is assured because of the generation of the hydride ions during the course of the reaction.

Many alternatives to formaldehyde have been suggested. U.S. Pat. No. 3,607,317 discloses the use of paraformaldehyde, trioxane, dimethyl hydantoin and glyoxal (which are all precursors or derivatives of formaldehyde) and borohydrides, such as sodium and potassium borohydride, substituted borohydrides, such as sodium trimethoxy borohydride, and boranes such as isopropylamine borane and morpholine borane. Hypophosphites such as sodium and potassium hypophosphite are also disclosed as having been used in acid electroless copper solutions. U.S. Pat. No. 4,171,225 discloses a reducing agent which is a complex of formaldehyde and an aminocarboxylic acid, an aminosulphonic acid or an aminophosphonic acid.

Aldehydes other than formaldehyde and which can undergo the Cannizzaro reaction have also been proposed for use in electroless copper, but they suffer from the disadvantage of being capable of undergoing the aldol condensation which results in the formation of long chain polymers and, eventually, resins. Further, other aldehydes are generally volatile, like formaldehyde, and/or are so hydrophobic in nature as to be insoluble in water.

Pushpavanam and Shenol, in an article in 'Finishing Industries', October 1977, pp 36 to 43, entitled 'Electroless Copper' reviewed the use of hypophosphites, phosphites, hyposulphites, sulphites, sulphoxylates, thiosulphites, hydrazine, hydrazoic acid, azides, formates and tartrates in addition to formaldeyde.

In spite of all these various proposed alternatives to formaldehyde, none seems to have been a particularly conspicuous commercial success. U.S. Pat. No. 4,279,948, which itself advocates the use of hypophosphites as reducing agents in electroless copper plating compositions, tends to confirm this as it states at lines 58 and 59 of column 2 that:

> For copper, formaldehyde is the overwhelming choice in commercial plating today.

This is possibly a result of the relative cheapness of formaldehyde.

Although hypophosphites have been among the most commonly proposed non-formaldeyde-derived reducing agents, they suffer from the major drawback for some applications of being non-autocatalytic. It is therefore difficult to produce more than a flash layer of copper using them.

It has now been discovered that glyoxylic acid (known in standardised modern chemical nomenclature as oxoethanoic acid) functions as a highly satisfactory reducing agent in alkaline electroless copper plating compositions. Although glyoxylic acid itself has of course been known for some considerable time, the usefulness of incorporating it into electroless copper baths has not been appreciated until the present invention was made. If anything, the art has taught away from the use of glyoxylic acid. Saubestre, in *Proc. Amer. Electroplater's Soc.,* (1959), 46, 264, refers to various oxidation products of tartaric acid (namely glyoxylic acid, oxalic acid and formic acid) as being reducing agents which "may reduce cupric salts beyond the cuprous state". However, he goes on to say that:

> "No success was obtained in any experiments involving use of these materials as reducing agents."

Now Saubestre did not disclose what the ingredients of the compositions of his experiments were. Specifically, he does not say whether the compositions are acid or alkali, although he does mention that a complex of a copper (II) ion and a tartrate ion is stable in alkali. Neither does he say whether any complexing agent for the copper was used. It is therefore impossible to guess why Saubestre's experiments were not a success, but the fact remains that he did not disclose how to provide a functioning electroless copper plating composition using glyoxylic acid. What he did do was to discourage any further work on the possible use of any of the reducing agents that he mentioned as being suitable candidates for incorporation into electroless copper plating compositions.

Contrary to what would naturally be expected from Saubestre's teachings, research work that culminated in the present invention has established that glyoxylic acid can function as a reducing agent in alkaline electroless copper compositions. And because glyoxylic acid exists in the form of the glyoxylate anion in alkaline solution, and not as a dissolved toxic gas, many of the safety and environmental problems associated with the use of formaldehyde can be circumvented. Furthermore, the behaviour of glyoxylic acid as a reducing agent has similarites with that of formaldehyde (it also will undergo the Cannizzaro reaction but will be oxidised and reduced to oxalic acid and glycollic acid) and results in the liberation of a hydride ion: this enables its use as an autocatalytic reducing agent.

According to a first aspect of the present invention, there is provided a composition for the electroless deposition of copper, the composition comprising a source of copper ions, an effective amount of a complexor to keep the copper ions in solution, the complexor being capable of forming a complex with copper which is stronger than a copper-oxalate complex and a source of glyoxylate ions, the amounts of complexor and glyoxylate being sufficient to allow copper deposition from the composition, with the proviso that, when the complexor is tartrate, the molar ratio of tartrate to copper is at least 6:1.

It is to be understood that the terms 'glyoxylic acid' and 'glyoxylate' are used interchangeably in this specification, unless the context requires otherwise, as the exact nature of the species present will depend in the pH of the composition; and that the same consideration applies to other weak acids and bases.

The source of copper may be any soluble copper salt that is compatible with the composition as a whole. Copper chloride and copper sulphate are generally preferred because they are readily available, but it is possible that nitrate, other halide or organic salts such as acetate may be found desirable in some circumstances. Generally speaking, the amount of copper that should be incorporated in the bath will be within the range of from 0.5 to 40 g/l (0.0078 to 0.63 molar), preferably from 2 to 10 g/l (0.031 to 0.16 molar) and typically in the order of 3 g/l (0.047 molar).

The complexor will generally be capable of forming a stable, water-soluble complex of copper in the bath, preferably under conditions of high pH (for example up to pH 12 and above) and high temperature (for example up to boiling). The function of the complexor is to prevent the precipitation of copper oxides or hydroxides or insoluble copper salts, such as copper oxalate, from the aqueous composition. The significance of preventing the precipitation of copper oxalate is that when glyoxylic acid functions as a reducing agent it is itself oxidised to oxalic acid: there will thus tend to be a build-up of oxalate ions when the bath is in use.

It appears that most if not all of the copper complexors proposed for use in formaldehyde-containing electroless copper plating compositions are also suitable for use in compositions of the present invention. It is believed that the complexor should inhibit the co-ordination of the copper in solution with water or hydroxyl ions, because (it is further believed) the formation of copper-hydroxyl and copper-water bonds tends to result in precipitation of copper (I) oxide. It is therefore surmised, although we do not wish to be bound by this theory, that there is a need or at least a desirability for the complexor to occupy all or a majority (possibly at least five) of the six co-ordination sites of the copper ion in solution.

The complexor may be a compound of the formula:

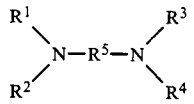

wherein each of $R^1$, $R^2$, $R^3$ and $R^4$ independently represents a hydrogen atom, a carboxyl group or a lower alkyl group (e.g. having from 1 to 4 or 6 carbon atoms) substituted with one or more carboxyl and/or hydroxyl groups, and $R^5$ represents a bond or a lower alkylene chain (e.g. having from 1 to 4 or 6 carbon atoms) optionally interrupted with one or more substituted nitrogen atoms, the substituent on the nitrogen atom being defined as for the substituents $R^1$ to $R^4$, with the proviso that the compound has a total of at least two groups which are carboxyl or hydroxyl groups.

Alternatively, the complexor may be a compound of the formula:

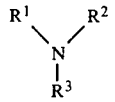

wherein $R^1$ represents a hydrogen atom or a carboxy lower alkyl or hydroxy lower alkyl group and each of $R^2$ and $R^3$ independently represents a carboxy lower alkyl or hydroxy lower alkyl group, each 'lower alkyl' moiety generally having from 1 to 4 or 6 carbon atoms.

Examples of classes of suitable complexing agents include:

1. Hydroxy lower alkyl lower alkylene (or lower alkyl) amines, diamines, triamines and other polyamines or imines, the alkyl or alkylene moieties having from 1 to 4 or 6 carbon atoms for example, such as tetra-2-hydroxypropyl ethylene diamine (EDTP);
2. Lower alkyl carboxylic acid lower alkylene amines, diamines, triamines or polyamines or imines, the lower alkyl or lower alkylene moieties again having from 1 to 4 or 6 carbon atoms for example, such as ethylene diamine tetraacetic acid (EDTA) and diethylene triamine pentaacetic acid;
3. Compounds which have attributes of compounds of classes 1 and 2 above, that is to say hydroxyalkyl or alkylene carboxylic acid amines, diamines, triamines, polyamines or imines, such as N-2-hydroxyethyl ethylene diamine-N,N',N'-triacetic acid; and
4. Hydroxy mono-, di-, tri- or tetra-carboxylic acids, having for example 1 to 6 carbon atoms other than in the carboxyl group(s), such as gluconate and glucoheptonate.

Complexors may be used either singly or as a compatible mixture, provided only that the total amount is effective.

Preferred complexors correspond to one of the following general formulae:

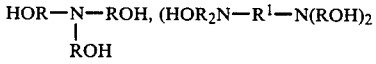

and

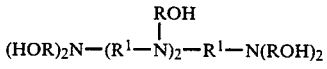

where R is an alkyl group having from two to four carbon atoms, $R^1$ is a lower alkylene radical (eg having from one to five carbon atoms) and n is a positive integer (eg from 1 to 6).

Examples of these complexing agents include EDTP, pentahydroxypropyl diethylene triamine, trihydroxypropylamine (tripropanolamine) and trihydroxypropyl hydroxyethyl ethylene diamine. EDTP is especially preferred as it enables plating to be achieved at a satisfactory rate. Plating using EDTA as the complexor is slower but results in a better quality product. Which is to be preferred in practice will depend upon the particular commercial application that the plated substrate is intended for.

Other complexors which may be used include ethoxylated cyclohexylamines, there being at least two ethoxy groups attached to the nitrogen atom and not more than 25 ethoxy groups in total, and benzyliminodiacetic acid; these compounds are disclosed in U.S. Pat. No. 3,645,749.

Other specific complexors which can be used in the present invention include nitrilotriacetic acid, glycollic acid, iminodiacetic acid, polyimines and ethanolamine, although it will be understood that some will not work as well as others under given conditions. Given the variety of complexors with which it is possible to achieve highly satisfactory results, it will be understood that it is possible to formulate an electroless copper plating composition in accordance with this invention which is free of tartrate ions, such as may be provided by Rochelle salt.

In general, and subject to the particular preference stated above, the amount of complexor that should be present in the composition for good results will depend on the amount of copper present, and the nature of the complexor itself. The most effective complexors may be found to be chelators. The optimum amount for penta-, hexa- and heptadentate chelators (which are preferred) may be about 1.5 times the concentration of copper in the composition, both calculated on a molar basis. It may more generally be the case that the molar ratio of copper ion to complexor concentrations will fall within the range of from 1:0.7 to 1:3 or beyond, up to the limit of solubility of the complexor or other bath compatibility. Bi-, tri- and tetradentate chelators will usually require higher molar concentrations relative to the copper concentration.

As previously indicated, when tartrate is used as the complexor, the minimum level of tartrate to be present in the bath will depend on the amount of copper present. The minimum molar concentration should be at least six times that of copper. Preferably the molar ratio of tartrate to copper will be at least 7:1, 8:1, 9:1 or 10:1. A higher ratio is likely to result in more even copper deposition, up to the limit of composition incompatibility of the tartrate, but the deposition obtained with the minimum amount being present may be enough for some purposes.

Hydroxyl ions are preferably to be present to maintain an alkaline pH generally above 10.5 or 11, and preferably from 12.5 to 13. They may be provided by any compatible and effective alkali such as an alkali metal hydroxide, for example sodium hydroxide or potassium hydroxide. The concentration of hydroxyl ions in the bath may be from 2 to 60 g/l of sodium hydroxide (0.05 to 1.5 molar), preferably from 5 to 20 g/l (0.125 to 0.5 molar), for example about 10 g/l (0.25 molar). Potassium hydroxide may be preferred since oxalate ions build up in the working solution and potassium oxalate is more soluble than sodium oxalate.

The source of glyoxylate ions may be glyoxylic acid itself, although it is to be appreciated that in aqueous solution the aldehyde containing acid is in equilibrium with its hydrate, dihydroxy acetic acid. An appreciation of this phenomenon will enable those skilled in the art to realise that the source of glyoxylic acid may alternatively or in addition be a dihaloacetic acid, such as dichloroacetic acid, which will hydrolyse in an aqueous medium to the hydrate of glyoxylic acid. An alternative source of glyoxylic acid is the bisulphite adduct as is a hydrolysable ester or other acid derivative. The bisulphite adduct may be added to the composition or formed in situ. It appears to allow the formation of good deposits at higher temperatures and plating rates. The bisulphite adduct may be made from glyoxylate and either bisulphite, sulphite or metabisulphite. Whatever the source of glyoxylic acid adopted it should generally be used in such an amount that the available glyoxylic acid will be present in the bath in an amount of from 0.01 to 1.5 molar, preferably from 0.05 to 0.5 molar, for example about 0.1 molar.

An optional but highly preferred component of the compositions of this invention is at least one rate controller and/or stabiliser. These are compounds which generally form strong copper (I) complexes, thus inhibiting the formation of copper (I) oxide. Combinations of such compounds may be found to be especially preferred. Because copper is autocatalytic, random copper particles that may form in solution would be plated indefinitely if they were not stabilised. An electroless copper stabiliser causes the plating rate at a given copper surface to diminish as the plating time increases. Among the reasons for using a stabiliser are the danger that if one were not used the composition may be decomposed and the fact that its presence may limit deposition to the substrate being plated. If no stabiliser were present, copper particles or solid impurities falling to the bottom of the plating tank may be plated. Furthermore, it may be that they would continue to be plated in an uncontrolled manner until the solution decomposed due to massive tank plating. The stabilisers and/or rate controllers, which may have a grain-refining and ductility-improving effect on the copper deposits, thereby improving the visual appearance of the deposit and enabling easier inspection, are generally the same as those that have been found to be useful in formaldehyde electroless copper deposition compositions. They fall into at least six categories:

1. Cyanides and complexes of cyanide—such as tetracyanoferrate (II) (ferrocyanide);
2. Organic nitrogen-containing compounds—such as 2,2-bipyridyls, hydroxypyridine and 2,2'-dipyridylamine—and the nitrogen containing compounds of U.S. Pat. No. 4,301,196;
3. Organic sulphur-containing compounds in which the sulphur is divalent, such as 2-mercaptopyridine, allyl thiourea, 2-mercaptobenzothiazole and 2-mercaptothiazoline;
4. Inorganic thio compounds including sulphites, thiocyanates, thiosulphates and polysulphides—these compounds also generally contain divalent sulphur;
5. Long chain organic oxo polymers, such as those of U.S. Pat. No. 3,607,317 which are polyalkylene oxides having up to 7 carbon atoms per alkylene moiety and a molecular weight of at least 6000 and preferably in the order of 5,000,000, examples of which are polyethylene oxide and polypropylene oxide. It is speculated that at least this class of stabilisers function by encapsulating nascent copper grains, thereby preventing them from gaining in size; and
6. Wetting agents.

U.S. Pat. No. 4,450,191 discloses what may be a seventh class of stabiliser for electroless copper, namely ammonium ions.

Rate controllers corresponding to the above classes may generally be used in the following amounts:

1. For cyanide ions, from 0 to 50 mg/l preferably from 5 to 30 mg/l, for example 10 mg/l; for potassium tetracyanoferrate (II), from 20 to 500 mg/l, preferably from 50 to 200 mg/l, for example 100 mg/l (with amounts for other tetracyanoferrates (II) being calculated on an equivalent basis);
2. For 2,2-bipyridyl, hydroxypyridine and other compounds, from 0 to 30 mg/l, preferably from 5 to 20 mg/l, for example 10 mg/l;
3. For organic sulphur-containing compounds from 0 to 15 mg/l, preferably from 0.5 to 5 mg/l, for example 3 mg/l;
4. For inorganic thio compounds, from 0 to 5 mg/l, preferably from 0.1 to 2 mg/l, for example 0.5 or 1 mg/l;
5. For long chain organic oxo compounds, from 0 to 100 mg/l, preferably from 2 to 50 mg/l, for example 20 mg/l; and
6. For wetting agents, from 0.1 to 20 mg/l, preferably from 0.5 to 10 mg/l, for example 2 mg/l.

Although indications of the concentrations of ingredients generally and preferably used have been given, it is to be understood that the optimum amounts will depend on the precise conditions used and will be readily determinable by those skilled in the art. In particular, the optimum concentrations of the hydroxyl ions, the source of glyoxylate and the stabiliser and/or rate controller (when present) will depend on each other and the temperature at which plating takes place.

Glycolic acid may be present in the bath from the outset. Although, even if it is not initially added, the concentration will build up as it is a reaction product of glyoxylate, it may in some circumstances be preferred to add it initially as it appears to have a beneficial effect on bath stability. This advantage may be felt to outweigh the slight effect that it has of reducing the thickness of the resulting copper deposit obtained in a given period of time. When initially provided, the glycolic acid may be present in an amount of from 0.1 to 50 g/l, preferably 1 to 20 g/l and typically from 5 to 10 g/l.

According to a second aspect of the invention, there is provided a process for the electroless deposition of copper on a substrate, the process comprising contacting the substrate with a composition comprising a source of copper ions, an effective amount of a complexor to keep the copper ions in solution, the complexor being capable of forming a complex with copper which is stronger than a copper-oxalate complex, and a source of glyoxylate ions, the amounts of complexor and glyoxylate being sufficient to allow copper deposition from the composition, with the proviso that, when the complexor is tartrate, the molar ratio of tartrate to copper is at least 6:1. The composition may be alkaline. Optionally but preferably a stabiliser or rate controller may be present.

The process will generally be carried out at a temperature of from 20 to 85 degrees C. typically from 40 to 50 degrees C., although the precise optimum in any instance will depend on the particular composition used.

It is preferred that the composition be agitated during use. In particular, work- and/or solution-agitation may be used. Air agitation, which may be achieved by bubbling air through the composition in use, has been found to be particularly effective as it apparently increases the stability of the composition.

The process will be carried out for a sufficient time to yield a deposit of the thickness required, which in turn will depend on the particular application. One application that it is envisaged that the present invention will be particularly suitable for is in the preparation of printed circuit boards. This may be by the subtractive processes (low build or high build), both of which start with a copper-clad laminate, the semi-additive process or the additive process. In all these cases, the electroless deposition of copper is important at least in the through-plating of holes drilled in the laminate. For the low build subtractive process, thicknesses of electroless copper deposits in the order of 0.5 microns are typically aimed for, whereas in the high build subtractive process thicknesses in the order of 2.5 microns are typical. In the semi-additive process, thicknesses of electroless copper deposits ranging from 2 to 10 microns are achieved, whereas in the additive process the thickness of the electroless copper layer may be from 25 to 50 microns. It can therefore be seen that the process of the invention may be useful in providing electroless copper deposits both less than and greater than 1 micron thick.

Double sided or multilayer boards (rigid or flexible) may be plated by means of the present invention.

The laminates that are generally used for printed circuit board manufacture are most frequently epoxy glass. But other substances, notably phenolics, polytetrafluoroethylene (PTFE), polyimides and polysulphones can be used.

Aside from the application of this invention in the production of PCBs, it may be found to be useful in plating non-conductive substrates generally, including plastics (such as ABS and polycarbonate), ceramics and glass. It is envisaged that one of the prime applications of this invention will be in the production of electromagnetic interference (EMI) shielding.

In general it is desirable to sensitise substrates prior to the deposition of electroless copper on them. This may be achieved by the adsorption of a catalysing metal (such as a noble metal, for example palladium) onto the surface of the substrate.

For printing circuit board laminates (and other suitable substrates) this may be done by first cleaning and conditioning the substrate to increase adsorption; secondly etching any copper cladding that is present to allow a good bond between the electroless-deposited copper and the cladding (this may be done by persulphate or peroxide based etching systems); thirdly contacting the substrate in a catalyst pre-dip preparation such as a hydrochloric acid solution, optionally with an alkali metal salt such as sodium chloride also in the solution; fourthly causing the surface to become catalytic, for example by contacting it with a colloidal suspension of palladium in an aqueous acidic solution of tin chloride; and fifthly contacting the substrate with an accelerator such as fluoboric acid or another mineral acid or an alkali—this last step removes tin and prevents drag-in. There are generally water rinses after the first, second, fourth and fifth steps.

Although what has just been exemplified is a one-step acid process, it is equally possible to use the rather older two-step process, that is to say first using a tin bath (for example) and then a palladium bath (again, for example). Baths in which the precious metal is deposited from alkali, rather than acid, solution can also be used. But, as the process of the present invention is autocatalytic, sensitisation is not essential, at least for copper plating.

For non-copper clad plastics, the procedure may be generally the same, except that plastics etchants frequently contain sulphuric, chromic and/or other acids. But in general there will usually be a step for rendering the surface physically receptive for electroless copper and/or a step for rendering the surface catalytic for the reduction of copper ions to copper metal. Alternatively, for PCB manufacture by the additive or semi-additive methods, pre-sensitised laminates may be used.

During plating, copper ions, glyoxylate ions and hydroxyl ions will be consumed. Therefore, according to a third aspect of the invention, there is provided a method of replenishing a composition for the electroless deposition of copper, the method comprising adding to the composition a source of copper, a source of glyoxylate ions and a source of hydroxyl ions. Rate controllers and stabilisers, if present, will also be consumed, and so these ingredients may also be replaced as necessary.

According to a fourth aspect of the invention, there is provided a substrate which has been plated with copper by means of a composition in accordance with the first aspect of the invention and/or by a process in accordance with the second aspect.

Preferred features of the second, third and fourth aspects are generally as for the first aspect mutatis mutandis.

The invention will now be illustrated by the following Examples:

EXAMPLE 1

800 ml of the following solution was prepared 8.0 g/l copper (II) chloride dihydrate [3.0 g/l Cu 0.047 molar]

20 g/l EDTP [0.068 molar]

30 g/l NaOH [0.75 molar]

12.5 ml/l dichloroacetic acid [0.15 molar]

and heated to 80 degrees C.

[Note: the reaction of the sodium hydroxide and dichloroacetic acid reduces the NaOH concentration to 0.6 molar].

This initially gave no deposit of copper on a palladium catalysed panel. However, after adding a further 10 g of sodium hydroxide and 5 ml of dichloroacetic acid and waiting 1 hour at 80 degrees C. a very thin copper deposit was observed. Further panels processed seemed to give thicker (darker) deposits, and after three to four hours (3–4) copper granules were observed on the bottom of the glass vessel.

The delay was possibly due to the hydrolysis of dichloroacetic acid being slower than expected.

The following examples relate to the use of glyoxylic acid solution (9.75 molar) in water, unless otherwise stated.

EXAMPLE 2

500 ml of the following solution was prepared 3 g/l copper (copper (II) chloride dihydrate [0.047 molar]

20 g/l EDTP [0.068 molar]

10 g/l NaOH [0.25 molar]

12.5 ml/l 9.75 molar aqueous glyoxylic acid solution [0.12 molar]

and heated to 70 degrees C. This solution did not fume and could be prepared and heated outside the fume cupboard.

[Note: a solution of 0.25 molar NaOH and 0.12 molar glyoxylic acid produces an analysed composition of 0.13 molar NaOH and 0.12 molar sodium glyoxylate. The NaOH concentration then further diminishes due to copper deposition and the Cannizzaro reaction.]

A catalysed panel was immersed for 10 minutes. Immediate initiation of deposition occurred accompanied by gas evolution. The copper deposit was dark pink, electrically conductive and adherent, and totally covered the panel including hole walls and edges. The deposit thickness, calculated from the weight gain was 2.94 microns. Some copper had deposited on the bottom of the glass vessel.

EXAMPLE 3

The procedure of Example 2 was followed but the solution was heated to 50 degrees C. A catalysed panel was immersed for 30 minutes. Initiation and gassing were observed within 10 seconds. The deposit was dark pink and adherent and through holes were plated. Deposit thickness was 3.92 microns. Some copper had deposited on the bottom of the glass vessel.

EXAMPLE 4

The procedure of Example 3 was followed but with an addition of 5 ppm cyanide (as NaCN). A catalysed panel was immersed for 30 minutes. Some copper was deposited on the bottom of the glass vessel but less than in Example 3. The deposit, which fully covered the panel, was lighter in colour than that from Example 3 and its thickness was 3.3 microns.

EXAMPLE 5

500 ml of a solution of the following composition was prepared 3 g/l copper (as copper (II) chloride dihydrate) [0.047 molar]

28 g/l tetra-sodium EDTA [0.067 molar]

10 g/l NaOH [0.25 molar]

11 ml/l glyoxylic acid solution [0.107 molar].

[Note: NaOH in solution is reduced to 0.143 molar with formation of glyoxylate].

The solution was heated to 50 degrees C. A catalysed epoxy glass panel was immersed for 30 minutes. The panel was fully covered with an aherent light pink copper deposit. The thickness was 1.65 microns. No copper was deposited on the bottom of the glass vessel.

EXAMPLE 6

500 ml of a solution of the following composition was prepared 5 g/l copper (as copper (II) sulphate pentahydrate) [0.078 molar]

40 g/l tetra-sodium EDTA [0.096 molar]

20 g/l NaOH [0.5 molar]

16 ml/l glyoxylic acid solution [0.156 molar]

and heated to 40 degrees C.

[Note: NaOH in solution is reduced to 0.344 molar with formation of glyoxylate].

A catalysed (activated) epoxy glass panel was immersed for 30 minutes. Electroless copper deposition and gas evolution occurred. The panel was fully covered with an adherent dark pink copper deposit. The thickness was 1.53 microns. No copper was deposited on the bottom of the beaker.

EXAMPLE 7

500 ml of a solution of the following composition was prepared 3 g/l copper (as copper (II) sulphate pentahydrate) [0.047 molar]
20 g/l EDTP [0.068 molar]
20 g/l NaOH [0.5 molar]
16 ml/l glyoxylic acid solution [0.12 molar]
1 mg/l sodium thiosulphate
and heated to 40 degrees C.

[Note: NaOH in solution is reduced to 0.13 molar with the formation of glyoxylate].

A catalysed epoxy glass panel was immersed for 30 minutes. A deposit of 4.14 microns of smooth dark pink copper which fully covered the panel was obtained. No copper was deposited on the bottom of the glass vessel.

EXAMPLE 8

500 ml of a solution of the following composition was prepared 2 g/l copper (copper (II) sulphate pentahydrate) [0.031 molar]
5 g/l sodium gluconate [0.023 molar]
10 g/l NaOH [0.25 molar]
12 ml/l glyoxylic acid [0.0195 molar]

[Note: NaOH in solution is reduced to 0.0605 molar with the formation of glyoxylate].

A dark blue solution was formed with a slight yellow precipitate. The solution was heated to 70 degrees C. and a catalysed panel was immersed for 30 minutes. Copper deposition occurred. The deposit was light pink and fully covered the panel. The thickness was 1.73 microns. At the end of the test some copper had deposited on the bottom of the glass vessel.

EXAMPLE 9

500 ml of a solution of the following composition was prepared 2 g/l copper (as copper (II) sulphate pentahydrate) [0.031 molar]
10 g/l potassium oxalate monohydrate [0.054 molar]
10 g/l NaOH [0.25 molar]
and heated to 60 degrees C. The constituents were added in the order given. A blue-green cloudy solution was formed with a grey precipitate. A further 10 g/l potassium oxalate monohydrate [0.054 molar] was added. The precipitate did not dissolve to any great extent. 18 g/l EDTP [0.0616 molar] was then added. Within 10 minutes a clear blue solution was obtained. 4 ml/l glyoxylic acid solution [0.039 molar] was then added. A catalysed epoxy glass panel was then immersed for 30 mintes. An adherent deposit of pink copper fully covering the panel was obtained. Deposit thickness was 2.40 microns. No copper was deposited on the bottom of the glass vessel.

EXAMPLE 10

500 ml of a solution of the following composition was prepared 4 g/l copper (as copper (II) sulphate pentahydrate) [0.062 molar]
20 g/l EDTP [0.068 molar]
20 g/l NaOH [0.5 molar]
10 ml/l glyoxylic acid solution [0.0975 molar]
and heated to 50 degrees C.

[Note: NaOH in solution is reduced to 0.4 molar with formation of glyoxylate].

A catalysed epoxy glass panel was immersed for 10 minutes. Initiation was very fast with vigorous gas evolution. A dark pink adherent copper deposit was obtained of thickness 3.73 microns.

EXAMPLE 11

The procedure of Example 2 was followed but with the addition of 10 mg/l 2,2'-bipyridyl.

A catalysed panel was immersed for 30 minutes. A light pink smooth and adherent deposit was obtained. Full coverage of the panel was obtained and the deposit thickness was 2.41 microns. Some copper was deposited on the bottom of the glass vessel but less than in Example 2.

EXAMPLE 12

The procedure of Example 2 was followed with the addition of 1.5 mg/l 2-mercaptothiazoline.

A catalysed panel was immersed for 30 minutes. The panel was fully covered with a smooth dark pink-brown deposit. No copper was deposited on the bottom of the glass vessel. The deposit thickness was 3.65 microns.

EXAMPLE 13

500 ml of a solution of the following composition was prepared 3 g/l copper (copper (II) chloride dihydrate) [0.047 molar]
22 g/l sodium gluconate [0.1 molar]
12 g/l NaOH [0.3 molar]
10.2 ml/l glyoxylic acid solution [0.1 molar]
and heated to 50 degrees C.

[Note: NaOH is reduced to 0.2 molar after glyoxylate formation].

The solution formed was dark blue and slightly cloudy. The cloudiness did not increase during the test. A catalysed panel was immersed for 30 minutes. Copper deposition started within 1 minute. After 5 minutes full coverage was evident. After 30 minutes 1.63 microns of light pink smooth adherent copper had been deposited. Some copper was deposited on the bottom of the glass vessel.

EXAMPLE 14

The procedure of Example 13 was followed except that 28.4 g/l [0.1 molar] of sodium glucoheptonate dihydrate was used in place of sodium gluconate.

A clear dark blue-green solution was formed. A catalysed panel was immersed for 30 minutes. Initiation occurred within 1 minute, and after 5 minutes full coverage was evident. After 30 minutes a deposit of 1.04 microns of smooth dark pink adherent copper was obtained. No copper had been deposited on the bottom of the glass vessel.

EXAMPLE 15

500 ml of a solution of the following composition was prepared 3 g/l copper (copper (II) chloride dihydrate) [0.047 molar]
29 g/l EDTP [0.1 molar]
12 g/l NaOH [0.3 molar]
630 mg/l sodium sulphite [0.005 molar]
10 ml/l glyoxylic acid solution [0.0975 molar]
and heated to 50 degrees C.

[Note: NaOH concentration will reduce to 0.2 molar after formation of glyoxylate ions].

A catalysed panel was immersed for 30 minutes. Initiation occurred immediately accompanied by gas evolution. A deposit of 5.94 microns of pink adherent copper was obtained. A small amount of copper was deposited on the bottom of the glass vessel.

EXAMPLE 16

500 ml of a solution of the following composition was prepared 3 g/l copper (as copper (II) chloride dihydrate) [0.047 molar]
29 g/l EDTP [0.1 molar]
12 g/l NaOH [0.3 molar]
13.8 g/l sodium sulphite [0.11 molar]
10 ml/l glyoxylic acid solution [0.1 molar]
and heated to 70 degrees C.

[Note: NaOH concentration will remain at 0.3 molar due to formation of glyoxylate-bisulphite addition compound].

A catalysed panel was immersed for 30 minutes. Initiation occurred immediately accompanied by gas evolution. A deposit of 12 microns of light pink smooth adherent copper was obtained. This deposit, although plated at a higher rate, was of a higher visible quality than that obtained in Example 15.

EXAMPLE 17

500 ml of a solution of the following composition was prepared 3 g/l copper (copper (II) sulphate pentahydrate) [0.047 molar]
15 g/l EDTP [0.051 molar]
12 g/l NaOH [0.3 molar]
1 mg/l sodium thiosulphate
5 mg/l 2,2'-bipyridyl
1 mg/l Pluronic P-85 wetting agent
10 ml/l glyoxylic acid [0.0975 molar]
and heated to 50 degrees C.

[Note: NaOH concentration will reduce to 0.2 molar on formation of glyoxylate].

A catalysed panel was immersed for 30 minutes after which time it was completely covered with a light pink finely grained copper deposit. The thickness of the deposit was 2.377 microns.

At the same time a catalysed double sided copper clad epoxy glass panel was immersed for 30 minutes. This panel contained 50 drilled holes varying in diameter from 0.8 mm to 2 mm. After electroless copper plating it was evident that copper had deposited to cover completely the edges of the panel and the sides of the hole walls. Closer inspection of the hole walls showed the absence of voiding (areas of misplating). The adhesion of the electroless copper to copper cladding was sufficient to withstand separation on to adhesive tape.

The plating solution so prepared was stable, no copper being deposited on the bottom of the glass vessel.

EXAMPLE 18

500 ml of a solution of the following composition was prepared 3 g/l copper (copper (II) chloride dihydrate) [0.047 molar]
39.3 g/l diethylenetriamine pentaacetic acid [0.1 molar]
32 g/l NaOH [0.8 molar]
10 ml/l glyoxylic acid solution [0.1 molar]
and heated to 60 degrees C.

[Note: After neutralisation of the diethylenetriamine pentaacetic and the glyoxylic acid the concentration of NaOH in the solution will be 0.2 molar].

A catalysed panel was immersed for 30 minutes. Initiation was observed within 10 seconds. After 30 minutes plating 2.0 microns of light pink adherent copper had been deposited. Some copper was deposited on the bottom of the glass vessel.

EXAMPLE 19

The procedure of Example 18 was followed but with the addition of 20 mg/l of a high molecular weight polyoxyethylene compound (Polyox Coagulant ex Union Carbide). A catalysed panel was immersed for 30 minutes. A coating of light pink adherent copper was obtained. Its thickness was 1.0 microns. No copper was deposited on the bottom of the glass vessel.

EXAMPLE 20

The procedure of Example 18 was followed except that air was passed through a sintered glass disc to aerate and agitate the solution. A light pink adherent copper deposit was obtained. Its thickness was 2.15 microns. No copper was deposited on the bottom of the glass vessel.

EXAMPLE 21

500 ml of the following composition was prepared 3 g/l copper (as copper (II) chloride dihydrate) [0.047 molar]
114 g/l nitrilotriacetic acid [0.6 molar]
84 g/l NaOH [2.1 molar]
10 m/l glyoxylic acid solution [0.1 molar]
and heated to 60 degrees C.

The concentration of NaOH was reduced to 0.2 molar after neutralisation of the acids. A catalysed panel was immersed for 30 minutes. A deposit which totally covered the catalysed panel of 3.64 microns of pink smooth adherent copper was obtained. Some copper was deposited on the base of the glass vessel.

EXAMPLE 22

500 ml of 10 molar glyoxylic acid solution was neutralised by slow addition with stirring of 400 ml of 10.27 molar potassium hydroxide. The mixture was cooled to maintain the temperature below 30° C.

The resulting solution was diluted to 1 liter to give a 5 molar solution of a mixture of potassium glyoxylate and glyoxylic acid at pH 3.9 to 4.0. This solution will be referred to as "reducer" in this Example and in Examples 23 to 25.

500 ml of a solution of the following composition was prepared:

3 g/l copper (as copper (II) chloride dihydrate) [0.047 molar];
20 g/l EDTP [0.068 molar];
15 g/l KOH [0.27 molar];
3 mg/l 2,2'-dipyridylamine;
20 ml/l reducer;
and heated to 55° C.

A catalysed panel was immersed for 30 minutes. Initiation was observed within 10 seconds. After 30 minutes plating 2.3 microns of pink adherent copper had been deposited. A small amount of copper was deposited on the bottom of the glass vessel.

EXAMPLE 23

500 ml of a solution of the following composition was prepared:

3 g/l copper (as copper (II) chloride dihydrate) [0.047 molar];
20 g/l EDTP [0.068 molar];
15 g/l KOH [0.27 molar];
6 mg/l sodium diethyl dithiocarbamate trihydrate;
20 ml/l reducer (from Example 22);
and heated to 55° C.

A catalysed panel was immersed for 30 minutes. Initiation was observed within 10 seconds. After 30 minutes plating 8.23 microns of dark pink adherent copper had been deposited on the bottom of the glass vessel.

EXAMPLE 24

The procedure of Example 23 was used except that 6 mg/l of 2-mercaptopyridine was used in place of sodium diethyldithiocarbamate.

After 30 minutes plating 5.50 microns of dark pink adherent copper had been deposited. Some copper was deposited on the bottom of the glass vessel.

EXAMPLE 25

The procedure of Example 23 now used except that 10 mg/l of allylthiourea was used in place of sodium diethyldithiocarbamate.

After 30 minutes plating 10.85 microns of dark pink adherent copper had been deposited. Some copper was deposited on the bottom of the glass vessel.

EXAMPLE 26

500 ml of a solution of the following composition was prepared:

3 g/l copper (as copper (II) chloride dihydrate) [0.047 molar];
20 g/l EDTP [0.068 molar];
15 g/l KOH [0.27 molar];
100 g/l potassium oxalate monohydrate;
1.5 mg/l sodium triosulphate;
11.4 g/l sodium glyoxylate monohydrate [0.1 molar];
and heated to 50° C.

A catalysed panel was immersed for 30 minutes. After 30 minutes plating 8.37 microns of dark pink adherent copper had been deposited. No copper was deposited on the glass vessel.

EXAMPLE 27

(This is a comparison example)

500 ml of a solution of the following composition was prepared 3 g/l copper (copper (II) chloride dihydrate) [0.047 molar]
28.2 g/l Rochelle salt (sodium potassium tartrate) [0.1 molar]
12 g/l NaOH [0.3 molar]
10.2 ml/l glyoxylic acid solution [0.1 molar]
and heated to 50 degrees C. The ratio of tartrate to copper was 2.13:1.

[Note: NaOH is reduced to 0.2 molar after glyoxylate formation].

Initially a clear blue solution was formed. A catalysed panel was immersed for 30 minutes. Initiation was patchy and only partial coverage of the panel with copper was achieved, with other areas being covered with what appeared to be copper (I) oxide. These areas were non-conductive. The solution became cloudy and an orange-red precipitate was observed on the bottom of the glass vessel.

EXAMPLE 28

500 ml of a solution of the following composition was prepared 3 g/l copper (as copper (II) sulphate pentahydrate) [0.047 molar]
84 g/l Rochelle salt (sodium potassium tartrate) [0.3 molar]
12 g/l NaOH [0.3 molar]
10 ml/l glyoxylic acid solution [0.1 molar]
and heated to 60 degrees C. The ratio of tartrate to copper was 6.3:1.

[Note: NaOH in solution drops to 0.2 molar on formation of glyoxylate].

The solution was turbid. A catalysed panel was immersed for 15 minutes. Initiation of plating and gassing was observed. A red precipitate was formed on the bottom of the glass vessel. The panel of area 58.2 squared cm estimated to be 90% covered in a smooth pink copper deposit. The thickness of this deposit was estimated to be 2.4 microns.

EXAMPLE 29

The procedure of Example 28 was followed except that the Rochelle salt concentration was increased to 168 g/l [0.6 molar] and copper (II) chloride dihydrate was used as the source of copper ions. The ratio of tartrate to copper was 12.6:1. A clear, not turbid, solution was obtained. A catalysed panel was immersed for 20 minutes. Initiation of copper deposition occurred within 1 minute. Total coverage by a smooth pink adherent copper deposit was achieved. The thickness of the deposit was 2.7 microns.

EXAMPLE 30

A bath of the following composition was prepared:

2 g/l copper (in UDIQUE ® 820A copper concentrate)
60 g/l KCl
143 g/l oxalic acid dihydrate
82.125 g/l KOH (as 182.5 g/l 45% KOH solution) [to neutralise oxalic and glycolic acids only]
7.6 g/l glycolic acid (as 10.1 ml/l of a 57% solution)
47.8 g/l $K_4$ EDTA
0.5 mg/l 2-mercaptothiazoline
7.4 g/l glyoxylic acid (as 11 ml of a 50% solution)
pH 12.7–13.0 (as measured by pH meter at 26° C.) adjusted with 45% KOH A suitably prepared ABS test panel was immersed in the bath, which was kept at 60° C., for 10 minutes. During the immersion the bath was air-agitated and appeared to be stable. A good copper deposit, 25–40 microinches (1–1.6 microns) thick was produced.

What I claim is:

1. In a composition for the electroless deposition of copper comprising in aqueous alkaline medium, a source of copper ions, an effective amount of a complexor to keep the copper ions in solution and a reducing agent; the improvement comprising, as said reducing agent, a source of glyoxylate ions, the amounts of complexor and glyoxylate being sufficient to allow copper deposition from the composition, with the proviso that, the complexor is capable of forming a complex with copper which is stronger than a copper-oxalate complex and when the complexor is tartrate, the molar ratio of tartrate to copper is at least 6:1.

2. A composition as claimed in claim 1, wherein the source of copper is a soluble copper salt that is compatible with the composition.

3. A composition as claimed in claim 1, wherein the source of copper provides a concentration of copper within the range of from 0.5 to 40 g/l (0.0078 to 0.63 molar).

4. A composition as claimed in claim 1, wherein the complexor is one of the following general formulae:

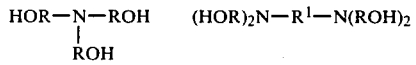

and

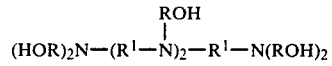

where R is an alkyl group having from two to four carbon atoms, $R^1$ is a lower alkylene radical and n is a positive integer.

5. A composition as claimed in claim 1, wherein the complexor is EDTP or EDTA.

6. A composition as claimed in claim 1, wherein the molar ratio of copper ion to complexor concentrations falls within the range of from 1:0.7 up to the limit of solubility of the complexor.

7. A composition as claimed in claim 1, wherein hydroxyl ions are present to maintain an alkaline pH above 10.5.

8. A composition as claimed in claim 1, wherein the source of glyoxylate ions is glyoxylic acid, dihydroxy acetic acid, a dihaloacetic acid, the bisulphite adduct of glyoxylic acid.

9. A composition as claimed in claim 1, wherein the source of glyoxylate ions is present in such an amount that the available glyoxylic acid will be present in the bath in an amount of from 0.01 to 1.5 molar.

10. A composition as claimed in claim 1, comprising at least one plating rate controller, stabiliser or mixtures thereof.

11. In a process for the electroless deposition of copper on a substrate, the process comprising contacting the substrate with a composition comprising, in aqueous alkaline medium, a source of copper ions, an effective amount of a complexor to keep the copper ions in solution, and a reducing agent; the improvement comprising, as said reducing agent, a source of glyoxylate ions, the amounts of complexor and glyoxylate being sufficient to allow copper deposition from the composition, with the proviso that, the complexor is capable of forming a complex with copper which is stronger than a copper-oxalate complex and when the complexor is tartrate, the molar ratio of tartrate to copper is at least 6:1.

12. A process as claimed in claim 11, wherein the complexor is one of the following general formulae:

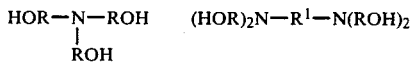

and

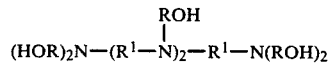

where R is an alkyl group having from two to four carbon atoms, $R^1$ is a lower alkylene radical and n is a positive integer.

13. A process as claimed in claim 11, which is carried out at a temperature of from 20° to 85° C.

14. A process as claimed in claim 11, wherein the composition is agitated during use.

15. A process as claimed in claim 14, wherein the agitation is air agitation.

16. A process as claimed in claim 11, wherein the substrate is sensitized prior to the deposition of electroless copper on it.

17. A process as claimed in claim 16, wherein the sensitization is achieved by the adsorption of a catalysing metal onto the surface of the substrate.

18. A method of replenishing a composition for the electroless deposition of copper, the method comprising adding to the composition a source of copper, a source of glyoxylate ions and a source of hydroxyl ions.

19. A method as claimed in claim 18, wherein one or more plating rate controllers, stabilisers or mixtures thereof are also added.

20. A substrate which has been plated with copper by a process as claimed in claim 11.

* * * * *